US005775802A

United States Patent [19]

Kuo

[11] Patent Number: 5,775,802

[45] Date of Patent: Jul. 7, 1998

[54] CLAMP DEVICE FOR WIRES OF ORNAMENTAL LAMP STRING

[76] Inventor: Cheng-Ju Kuo, 5F-7, No. 63, Sec. 2, Chang-An E. Rd., Taipei, Taiwan

[21] Appl. No.: 811,569

[22] Filed: Mar. 5, 1997

[51] Int. Cl.[6] ..... F21V 21/08

[52] U.S. Cl. ..... 362/396; 362/249; 362/806

[58] Field of Search ..... 362/123, 249, 362/252, 226, 391, 396, 806

[56] References Cited

U.S. PATENT DOCUMENTS

| | | | |
|---|---|---|---|
| 3,335,389 | 8/1967 | Reichardt | 362/249 |
| 5,632,550 | 5/1997 | Yeh | 362/123 |
| 5,645,342 | 7/1997 | Chang | 362/252 |

*Primary Examiner*—Y. My Quach

*Attorney, Agent, or Firm*—Bacon & Thomas

[57] ABSTRACT

A clamp device for wires of ornamental lamp string, in which the sub-sockets in every lamp string are set at a regular distance from one another, and two power-supply wires are connected with a connecting member. One of the two power-supply wires is connected with the connecting member and with all sub-sockets in series, while the other power-supply wire is connected from the connecting member to the last sub-socket directly so as to form a complete electrical circuit. A plurality of lamp strings are connected with the main cable of the power-supply wires. The wires between two adjacent lamp strings are fastened in place with a clasp mounted on a sub-socket. A plurality of lamp strings are connected into a network to be mounted over a wall surface or the like, and such network can be set up and removed quickly and conveniently.

3 Claims, 5 Drawing Sheets

CLAMP DEVICE FOR WIRES OF ORNAMENTAL LAMP STRING

BACKGROUND OF THE INVENTION

1. Field of the Invention

This invention relates to an ornamental lamp, particularly to a clamp device to be mounted on the surface of the socket of a lamp string so as to fasten power-supply wires in place.

2. Description of the Prior Art

In conventional ornamental lamp string for Christmas, a long lamp string usually comprises a plurality of short lamp strings connected in series; each short lamp string includes a plurality of sockets mounted with bulbs respectively; each short lamp string includes a flickering bulb, which is used as a switch to control the power supply of the rest bulbs in the string so as to have the whole lamp string flicker as an ornamental means.

Another conventional ornamental lamp string for Christmas is used for decorating a large area, such as a wall or the like; such a lamp string has two power-supply wires, of which each is connected with a plurality of sockets in series; one end of each of the two power-supply wires is directly connected with a main bulb of power-supply wires, or connected through a connecting member. All lamp strings are connected with the main cable of power-supply wires respectively so as to form into a large lamp string to be hung on a wall surface or the like for ornamental purpose; however, the aforesaid large lamp string is subject to twisting together at least partially upon being blown with wind; therefore, such lamp string is usually fastened in place with a net; in that case, the lamp string would cause more or less inconvenience upon being set up or removed from a site.

SUMMARY OF THE INVENTION

The prime object of the present invention is to provide a clamp device for wires of an ornamental lamp string, in which the sub-sockets in every lamp string are set at a regular distance from one another, and two power-supply wires are connected with a connecting member. One of the two power-supply wires is connected with the connecting member and with all sub-sockets in series at a regular distance one another, while the other power-supply wire is connected from the connecting member to the last sub-socket directly so as to form a complete electrical circuit. A plurality of lamp strings are connected with the main cable of power-supply wires; the wires between two adjacent lamp strings are fastened in place with a clasp upon the same being mounted on a sub-socket; then, a plurality of lamp strings are connected into a network to be mounted over a wall surface or the like. Such network can be set up and removed quickly and conveniently.

Another object of the present invention is to provide a clamp device for wires of an ornamental lamp string, in which one end of each sub-socket to be plugged with power-supply wires has a socket surface including two symmetrical flat surfaces and two curved surfaces so as to facilitate the mounting of a clasp. The clasp has a slot with semi-circular recesses on both ends of the slot to facilitate the insertion of power-supply wires in the clasp. As soon as the clasp is mounted over the socket surface of the sub-socket, the power-supply wires of an two adjacent lamp strings will be guided into a clamping groove to prevent the wires from being pulled and moved out of place unintentionally.

Still another object of the present invention is to provide a clamp device for wires of an ornamental lamp string, in which the clasp has a slot at one side thereof, and both ends of the slot are furnished with semi-circular recesses respectively; the diameter of each semi-circular recess is slightly larger than that of the power-supply wire; the power-supply wires are guided and inserted into the cylindrical part in the clasp through the semi-circular recess. The flat surface and the curved surface in the clasp are furnished with slipping-resistant threads respectively, and with a taper part same as that of the socket surface; after the clasp is mounted on the socket surface, a fastening force and positioning function will be furnished.

A further object of the present invention is to provide a clamp device for wires of an ornamental lamp string, in which the clasp part includes a clamping groove at one side thereof; the clamping groove is used for receiving the power-supply wire extended from an adjacent lamp string upon the clasp being mounted on the socket surface of a sub-socket so as to connect a plurality of lamp strings into a network.

DETAILED DESCRIPTION OF THE PREFERRED EMBODIMENT

Figure 1:
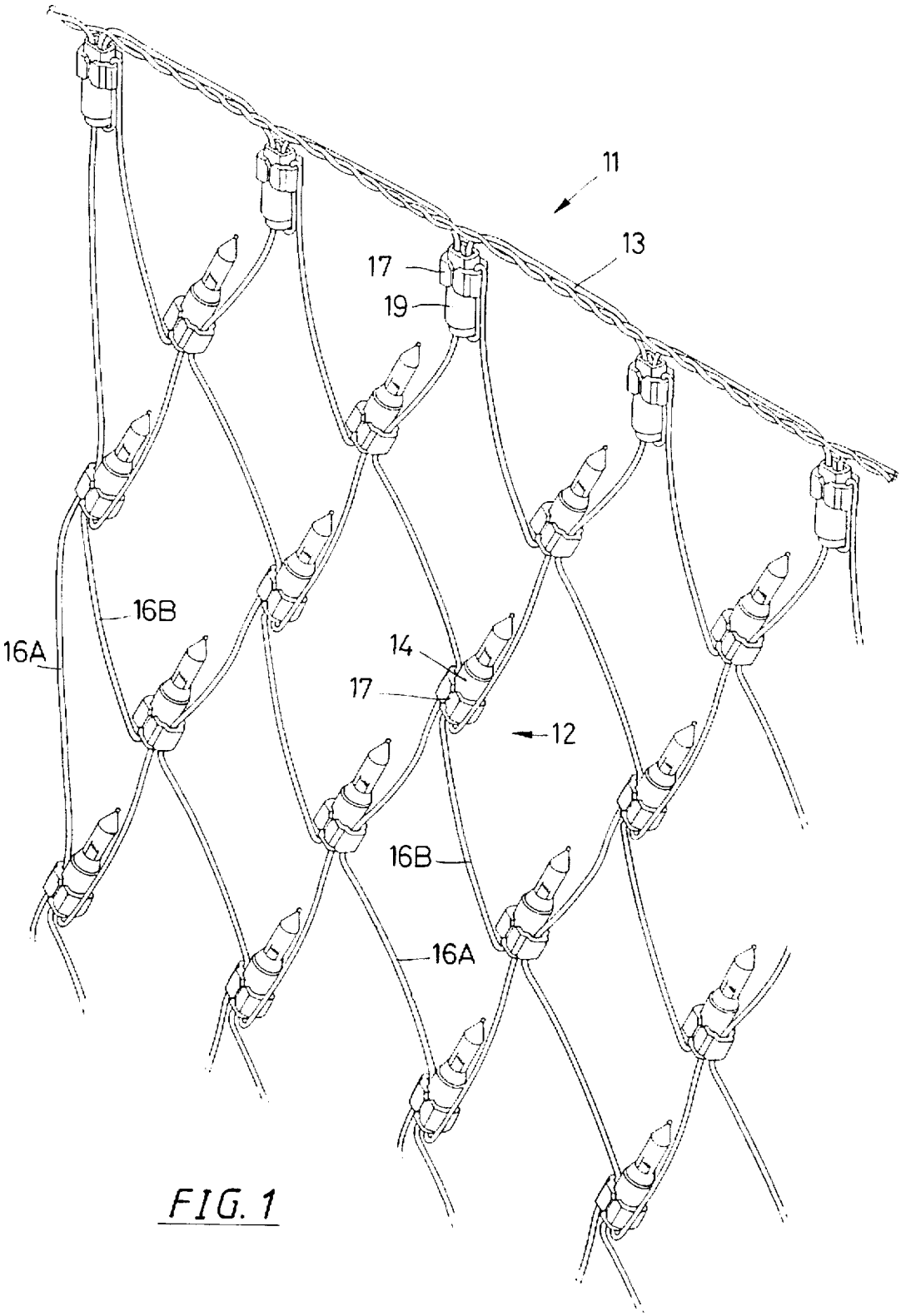
FIG. 1 is a plane view of the present invention, showing the clamp device fastening a plurality of lamp strings into a network.
Figure 2:
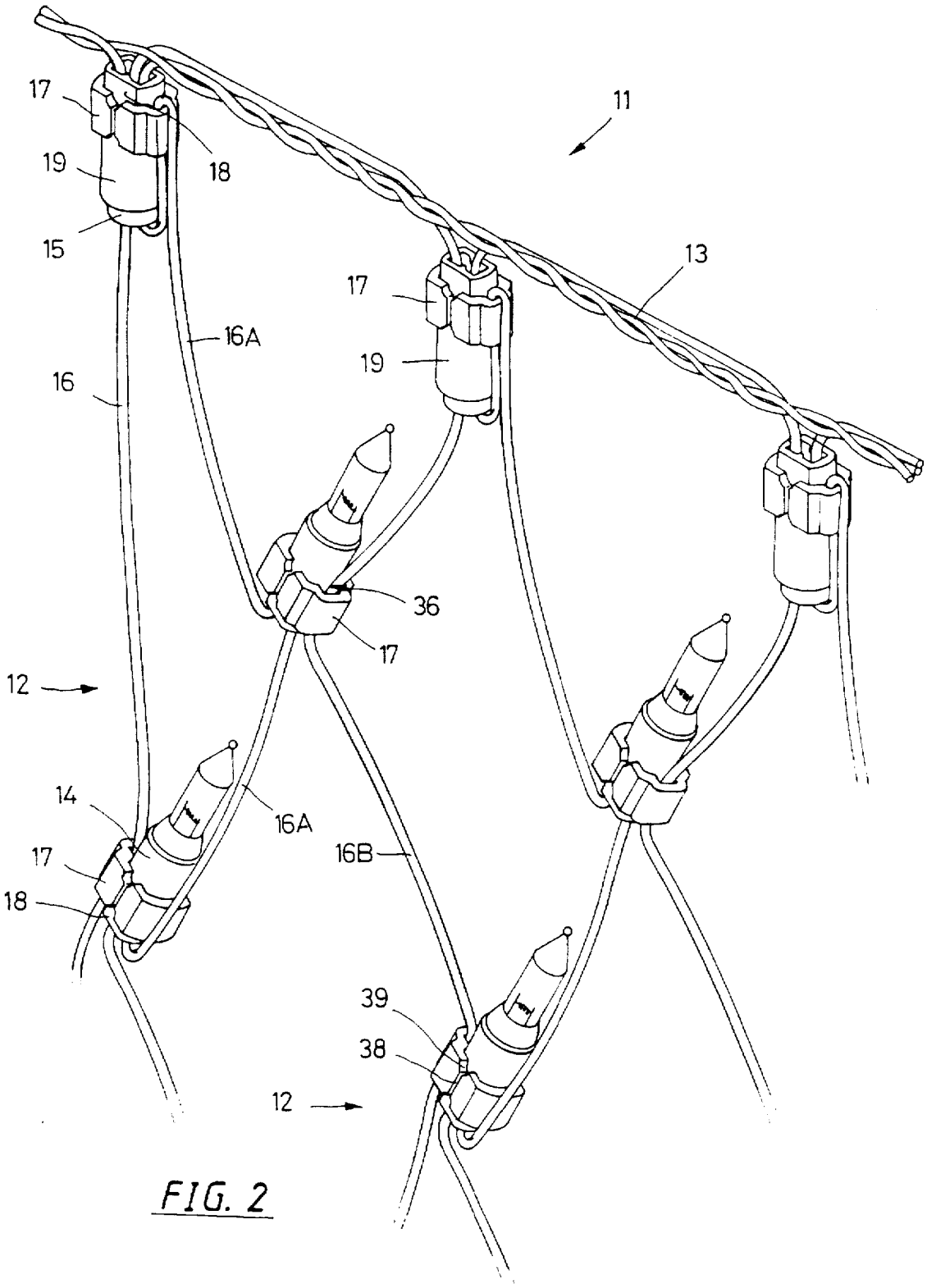
FIG. 2 is a perspective view of the present invention, showing the clamping relation between the clasp and the lamp string thereof.
Figure 3:
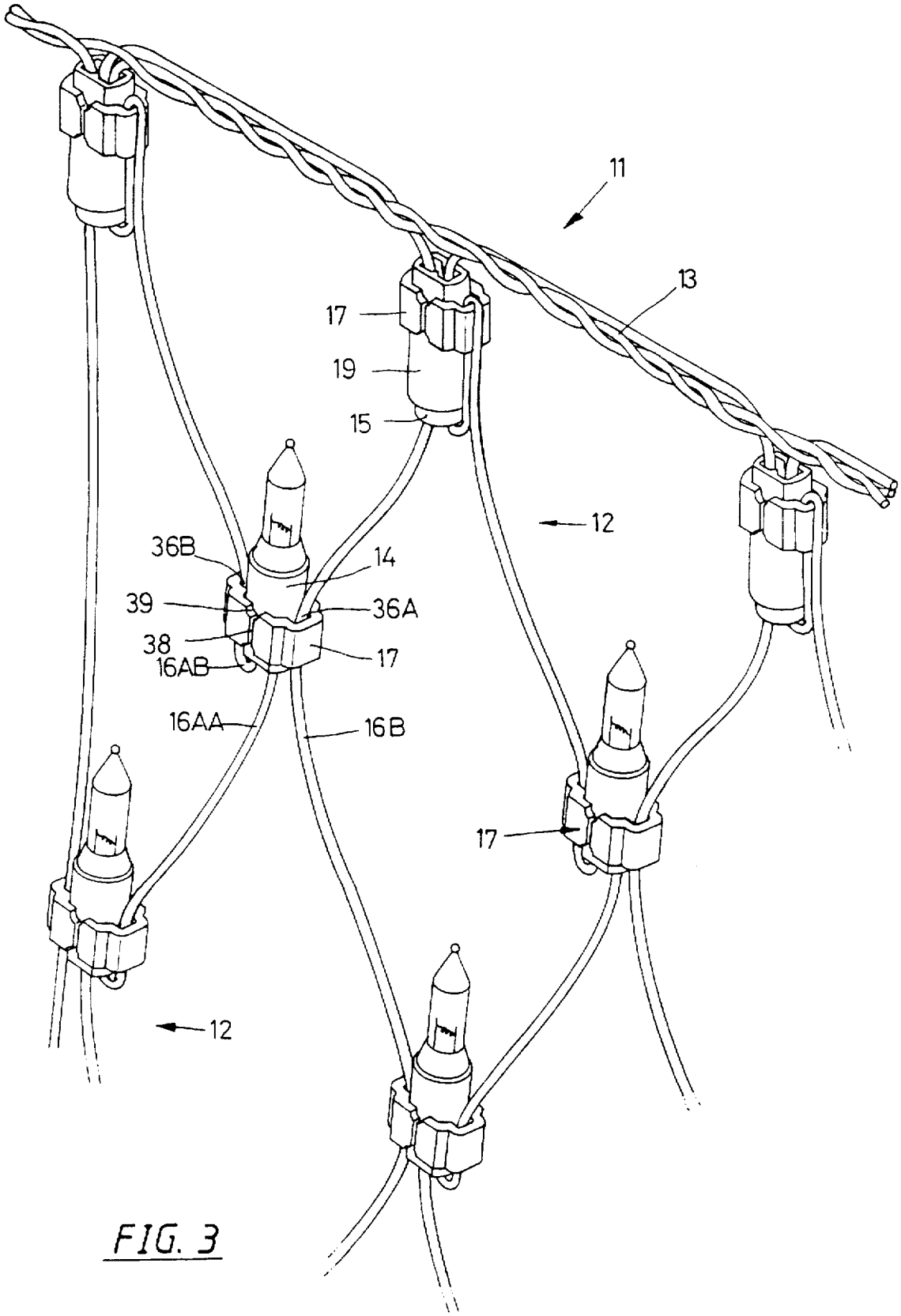
FIG. 3 is another perspective view of the present invention, showing the clamping relation between the clasp and the lamp string thereof.
Figure 4:
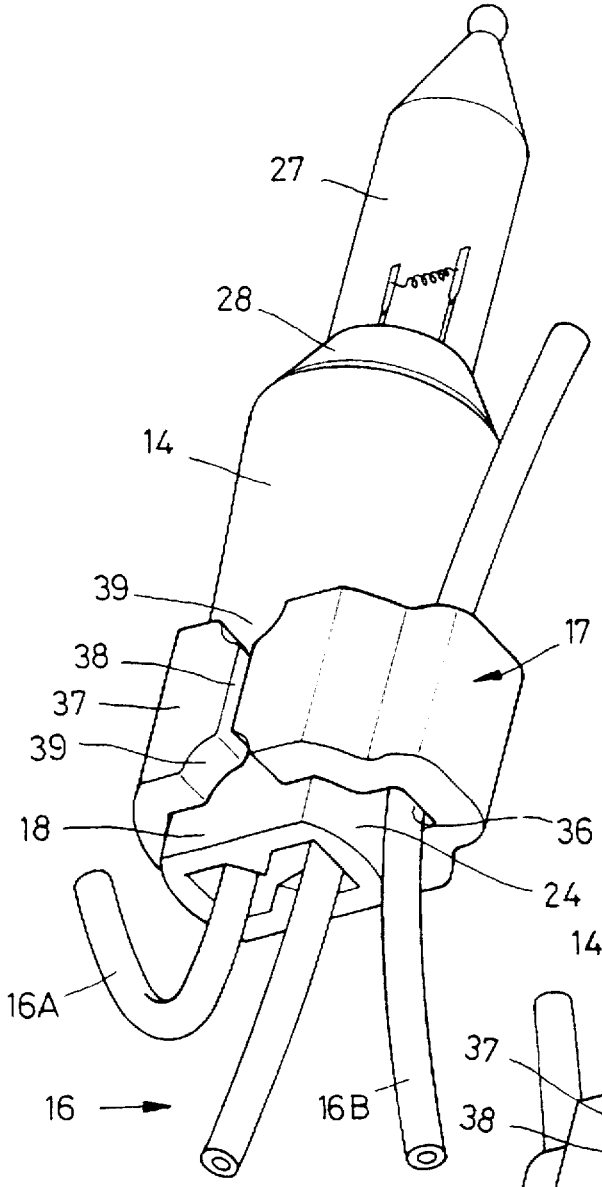
FIG. 4 is an enlarged perspective view of the present invention, showing the clamping relation between the clasp and the lamp string thereof.

Referring to FIGS. 1 to 3, the network-shaped ornamental lamps according to the present invention, comprises a main cable of power-supply wires 13 and a plurality of lamp strings 12; each lamp string 12 includes a connecting member 15 and a main socket 19 of the main cable of power-supply wires 13; each lamp string 12 includes one wire 16A connected in series with a plurality of sub-sockets, and one wire 16B being an independent wire. The socket surface 18 of every sub-socket 14 of each lamp string 12 is mounted with a clasp 17, which has a clamping groove 36 in one side thereof for fastening a power-supply wire 16B between two lamps so as to form an ornamental lamp network.

Figure 6:
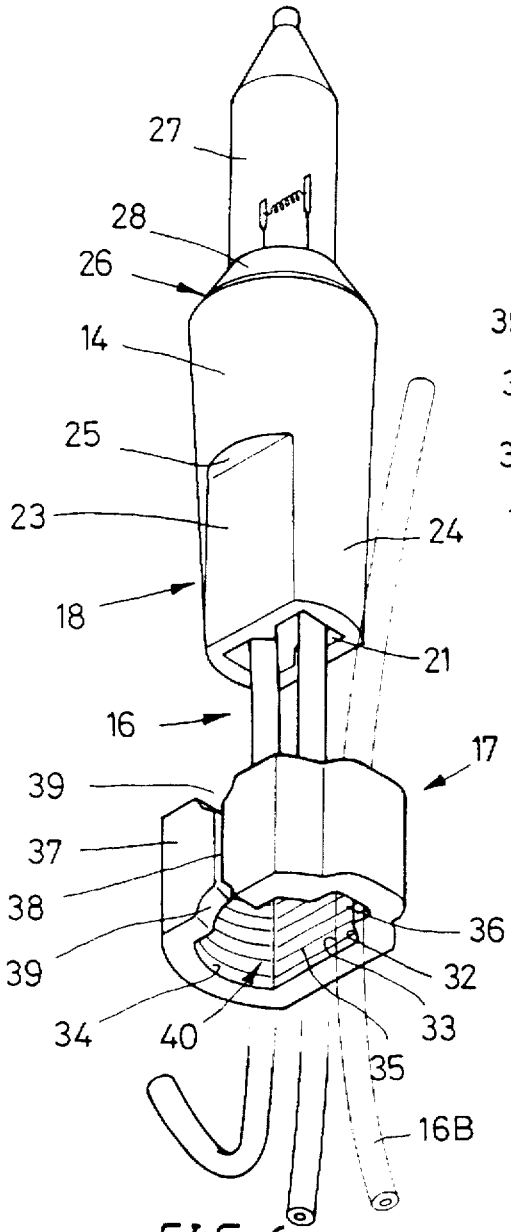
FIG. 6 is a disassembled view of the present invention, showing the relation between the clasp and the lamp string thereof.

Referring to FIG. 6, each sub-socket 14 in the lamp string 12 has, at one end, a socket hole 26 for fitting a bulb 27 and a connecting sleeve 28, while the other end thereof has a guide chute 21 for receiving the power-supply wires 16. The outer surface of the guide chute 21 has two flat sides 23 and two curved sides 24. Each of the two flat sides 23 has a stop shoulder 25. The two symmetrical curved sides 24 each have a taper from one end to the other end thereof. The two symmetrical two flat sides 23 and the curved sides 24 form a surface to facilitate mounting of the clasp 17.

Referring to FIGS. 1, 2, 4 and 6, a first embodiment of a clamp device according to the present invention is shown; the main cable of the power-supply wires 13 is connected with a plurality of main sockets 19, of which each is connected with a lamp string 12 by means of a connecting member 15 between the lamp string 12 and the main socket 19. Each lamp string 12 connected with the main socket 19 includes a plurality of sub-sockets 14, a power-supply wire 16A connecting the plurality of sub-sockets 14 in series, and an independent wire 16B. Each sub-socket 14 has a socket hole 26 for plugging a connecting sleeve 28 and a bulb 27. The lamp string 12 has two power-supply wires 16, of which the wire 16A is connected with and from the connecting member 15 to the next in series until the last sub-socket, while the other wire 16B is connected from the connecting member 15 to the last sub-socket 14 directly so as to form a complete electrical circuit for the lamp string 12.

The socket surface 18 of the sub-socket 14 of the lamp strings 12 connected with the main cable of the power-supply wires 13 is mounted with a clasp 17 having a clamping groove 36 in one side thereof for receiving an independent wire 16B of the lamp string 12 so as to prevent the independent wire 16B from moving. A plurality of lamp strings 12 is formed into a network of ornamental lamps 11.

The clasp 17 mounted on the socket surface 18 has a portion 40 to be mounted around the socket surface 18 of the sub-socket 14; in the portion 40, there are two symmetrical flat surfaces 33 and two curved surfaces 34; both the flat surfaces 33 and the curved surfaces 34 are furnished with suitable slipping-resistant threads 35; one of the curved surfaces 34 forms a clamping groove 36, and both sides of the clamping groove 36 have two small curved surfaces 32 respectively to form an angle with the flat surface 33.

The clamping groove 36 beside the clasp 17 is designed in accordance with the diameter of the independent wire 16B. The independent wire 16B is to be laid into the portion 40 through the slot 38 of the clasp 17; after the socket surface 18 of the sub-socket 14 is plugged into the clasp 17, the independent wire 16B will be fastened firmly between the clamping groove 36 and the curved side 24 of the socket surface 18.

The portion 40 of the clasp 17 is provided with a taper and a plurality of slipping-resistant threads 35, and the clasp 17 has a suitable thickness. The outer plate 37 of the clasp 17 has a slot 38, of which the width is slightly less than the diameter of a power-supply wire 16. Both ends of the slot 38 are furnished with semi-circular recesses 39 respectively, of which the diameter is slightly larger than that of the power-supply wire 16. The power-supply wires 16 are to be put into the portion 40 of the clasp 17 through the semi-circular recesses 39 so as to expand the width of the slot 38 upon wire being pulled. As soon as the power-supply wires 16 are pulled and inserted into the portion 40, the width of the slot 38 will restore to its normal width so as to prevent the wires from moving out of the slot 38.

Before a plurality of lamp strings 12 are assembled into a network of ornamental lamps, the two power-supply wires 16A on every sub-socket 14 must be mounted with a clasp 17 first, and then an independent wire 16B of the neighbor string 12 is put into the portion 40 from the upper part to the lower part thereof. The clamping grooves 36 in both sides of the clasp 17 are used for receiving the independent wire 16B. After the clasp 17 is mounted on the socket surface 18 of the sub-socket 14, they would not separate from each other unintentionally because of the taper in the portion 40, the slipping-resistant threads 35 therein, and the slight elastic force of the slot 38. As soon as the clasp 17 is firmly mounted on the socket surface 18 of the sub-socket 14, the independent wire 16B will be positioned firmly between the clamping groove 36 and the curved side 24 of the sub-socket 14.

Figure 7:
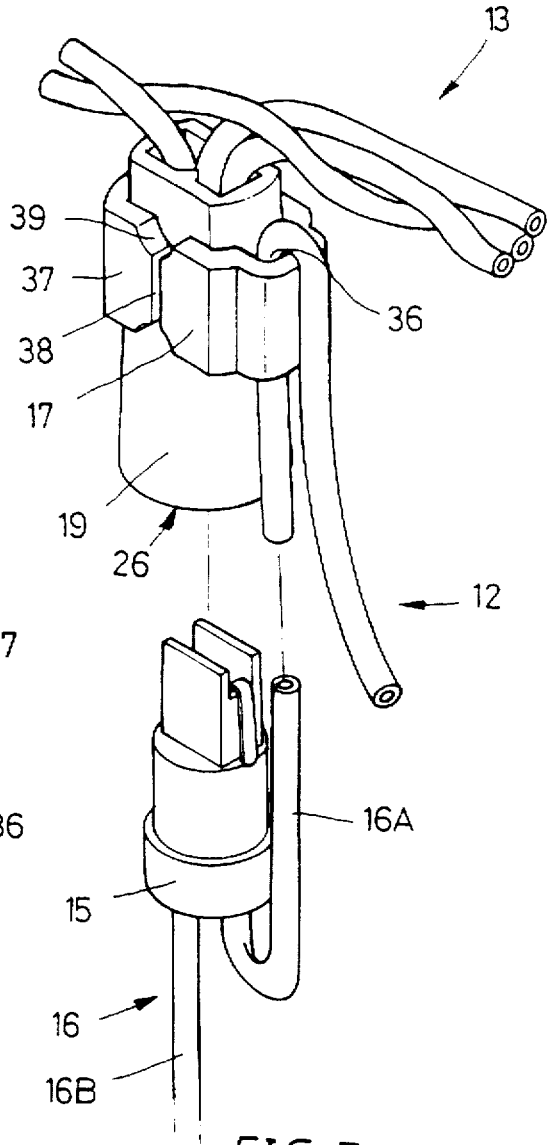
FIG. 7 is another disassembled view of the present invention, showing the relation between the clasp and the main socket thereof.

Referring to FIGS. 1, 2 and 7, the two power-supply wires 16 of each lamp string 12 are connected with the main cable of power-supply wires 13 through a connecting member 15. In order to prevent the connecting member 15 of the lamp string 12 being separated from the main socket 19 of the main cable of power-supply wires 13 as shown in FIG. 7, the shape of the connecting member 15 is the same as that of the connecting sleeve 28 of the bulb 27; the connecting member 15 can directly be plugged into the main socket 19 of the main cable of power-supply wires 13; each main socket 19 on the main cable of power-supply wires 13 is mounted with a clasp 17; one power-supply wire 16A in the connecting member 15 is laid into the portion 40 of the clasp 17; as soon as the clasp 17 is mounted on the main socket 19 of the main cable of power-supply wires 13, the clamping groove 36 of the clasp 17 will hold the power-supply wire 16A in place so as to prevent the connecting member 15 of the lamp string 12 from being separated from the main socket 19 of the main cable of power-supply wires 13.

Figure 5:
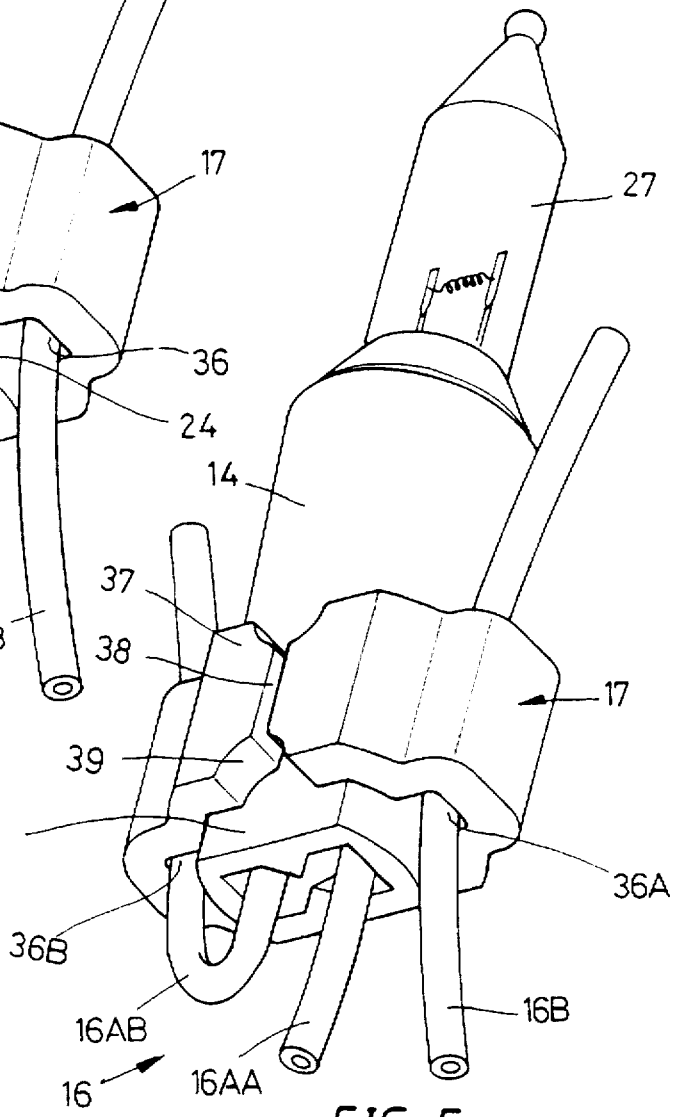
FIG. 5 is an enlarged perspective view of the present invention, showing the clamping relation between the clasp and the lamp string thereof.

The portion 40 of the clasp 17 has a clamping groove 36 extended from one side of the center of a curved surface 34 therein, and the clamping groove 36 is used for receiving the independent wire 16B so as to connect a plurality of lamp strings 12 into a network of ornamental lamps 11. Referring to FIGS. 1, 3 and 5, the two curved surfaces 34 of the portion 40 in the clasp 17 are furnished with two symmetrical clamping grooves 36 respectively. One power-supply wire 16AA and one independent wire 16B are to be mounted in respectively through the slot 38 and the semi-circular recesses 39; when the clasp 17 is mounted on the socket surface 18 of the sub-socket 14, the power-supply wire 16AA under the sub-socket 14 will pass through the clasp 17, while another power-supply wire 16AB connected to the sub-socket 14 is mounted in a clamping groove 36B, and the independent wire 16B is mounted in another clamping groove 36A of the clasp 17. After the clasp 17 is firmly mounted on the socket surface 18 of the sub-socket 14, the clamping grooves 36 on both sides of the clasp 17 will hold the power-supply wires 16 in place and in a given direction so as to facilitate a plurality of lamp strings 12 to be connected into a network of ornamental lamps.

The embodiments of the present invention have been described in detail to disclose the features and structure thereof; it is apparent that the present invention has shown the improvement thereof, which is never anticipated and accomplished by others so far; the structure of the present invention is deemed unique.

I claim:

1. A clamp device for wires of an ornamental lamp string having a main power supply cable connected with a plurality of main sockets, each main socket being connected to a connecting member of a lamp string each lamp string having first and second power-supply wires, the first power-supply wire extending from said connecting member and connecting a plurality of sub-sockets in series, the second power-supply wire extending from said connecting member to a last sub-socket in the series connection to provide a complete electrical circuit in series for each of said lamp strings, each sub-socket having an outer socket surface, said clamp device comprising:

a clasp removably mounted on the outer socket surface of at least one of said sub-sockets, the clasp having a portion with two symmetrical flat surfaces connected by two symmetrical curved surfaces; said flat surfaces and said curved surfaces all being tapered and having slipping-resistant threads, at least one of said two curved surfaces forming a clamping groove receiving one of said first and second power-supply wires therein an outer plate of one of said flat surfaces of said clasp having a slot with semi-circular recesses on opposite ends thereof to facilitate insertion of said one of said first and second power-supply wires into said clamping groove, such that said one of said first and second wires is fastened firmly between said clamping groove and a curved side of said outer socket surface.

2. The clamp device for wires of an ornamental lamp string as claimed in claim 1, wherein said two curved surfaces comprise two clamping grooves each configured for receiving a said first and second power supply wire therein.

3. The clamp device for wires of an ornamental lamp string as claimed in claim 1, wherein said slot in said outer plate of said clasp has a width smaller than a diameter of one of said first and second power-supply wires.

* * * * *